United States Patent [19]

Morris et al.

[11] 4,417,899

[45] Nov. 29, 1983

[54] SELF-BURSTING COAL PELLETS AND A METHOD OF MAKING THEM

[75] Inventors: John D. Morris, Norman, Okla.; Asadollah Hayatdavoudi, Lafayette, La.

[73] Assignee: The Board of Regents of The University of Oklahoma, Norman, Okla.

[21] Appl. No.: 331,803

[22] Filed: Dec. 17, 1981

[51] Int. Cl.[3] ..... C10L 5/14; C10L 5/32

[52] U.S. Cl. ..... 44/6; 44/15 R; 44/21; 44/25

[58] Field of Search ..... 44/15 R, 21, 25, 6

[56] References Cited

U.S. PATENT DOCUMENTS

| | | | |
|---|---|---|---|
| 2,673,812 | 3/1954 | Greaves et al. | 44/15 R |
| 2,822,251 | 2/1958 | Swinehart et al. | 44/15 R |
| 2,922,704 | 1/1960 | Dohmen | 44/15 R |

FOREIGN PATENT DOCUMENTS

| | | | |
|---|---|---|---|
| 47-8453 | 3/1972 | Japan | 44/15 R |

OTHER PUBLICATIONS

"Development and Properties of a Self-Bursting Pellet as Agglomerated from Coal Fines by Use of an Organic Binder", John D. Morris, Oklahoma Univ. Library, 1980.

*Primary Examiner*—Carl F. Dees

*Attorney, Agent, or Firm*—Dunlap & Codding

[57] ABSTRACT

A coal pellet which disintegrates in the presence of excess heat and comprises coal particles, water soluble binder and water. The binder is first dissolved in water and then coal particles are blended with the aqueous binder solution. The blend is agitated until pellets are formed and then the pellets are coated with a water resistant film. The coal pellets have water entrained therein which is converted to a gaseous form when the pellets are subjected to heat thereby facilitating the heat induced bursting of the pellets to free the coal particles for more efficient burning.

22 Claims, No Drawings

SELF-BURSTING COAL PELLETS AND A METHOD OF MAKING THEM

BACKGROUND OF THE INVENTION

With the development of increasingly mechanized systems for the mining, preparation and transportation of coal has come an increase in the quantity of fine coal particles produced. Such fine coal particles, commonly known as coal dust, are often lost during coal handling. Both wind and flowing water readily carry coal dust away. Coal losses due to wind and water are often substantial and add directly to the costs of coal as a fuel.

Ironically, once coal has been transported to an industrial site for usage, it often must be pulverized before burning. Pulverized coal forms fine particles similar to coal dust in many respects. Because of the high surface to volume ratios of coal particles, the coal itself has greater contact with atmospheric oxygen when in particulate form. This physical characteristic of coal particles explains, at least in part, the desirability of feeding industrial furnaces with pulverized coal rather than larger coal fragments. In other words, fine coal particles burn more efficiently than larger coal fragments.

Prior art in the field of this invention has been primarily directed toward the alleviation of coal dust losses by capturing the coal dust before its dispersal in the environment and then converting it into a stable form. In U.S. Pat. No. 3,655,350, issued to Utley in 1972, coal pellets with certain desirable characteristics were produced. These pellets contained coal dust, coal tar pitch and less than ten percent water. The pellets produced were reasonably stable to crushing and impact forces as well as resistant to water induced degradation. Drying the pellets in a fluid bed dryer for forty seconds at seven hundred and fifty degrees did not adversely affect pellet structure nor cause substantial losses of physical stability. Pellets using bentonite clay as a binder were found to have little resistance to destruction by water.

In U.S. Pat. No. 3,377,146, issued to von Stroh in 1968, a coal pellet containing coal dust and lignosulfonate binder is produced. The binder is a water soluble lignin derivative and serves to facilitate pellet formation. The resultant pellets were found to withstand temperatures of fourteen hundred degrees without loss of hardness.

In U.S. Pat. No. 4,025,596, issued to Parks, et al. in 1977, a method of pelletizing fine particles using a non-water soluble latex polymer and a hydrophilic agglutinant is taught. In some cases polyethylene glycol was used as an agglutinant along with a latex binder and fine coal particles. Pellets produced were dried, as example 1 indicates, at 200° F. for two hours.

As indicated by reports on agglomeration (*Chemical Engineering,* October 1951, 161–65 and *Chemical Engineering,* Dec. 4, 1967, 147–69) and by the common knowledge of practicioners of the art, the most frequently used coal particle binders in the past have been hydrophobic substances such as petroleum asphalt and coal tar or sometimes bentonite clays. Such pellets, although stable, are prone to burn inefficiently as compared to pulverized coal and also to sometimes produce noxious gases and become gummy when subjected to heat. In some cases excessive ash is produced. Such pellets, for efficient industrial combustion, must be first mechanically pulverized back to fine coal particles.

It is an object of the present invention to produce a stable coal pellet from fine coal particles which might otherwise be lost during coal preparation and transportation.

Yet another object of this invention is to produce a coal pellet which will burst into combustible coal dust particles upon subjection to heat such as during injection into a furnace.

Other objects and advantages of this invention will be evident from the following description of the preferred embodiment and accompanying tabular data.

DESCRIPTION OF THE PREFERRED EMBODIMENT

The method of the present invention is particularly adapted to produce a pellet which is self-bursting upon the application of heat. Following the method of the present invention, coal particles in the form of coal dust, water and a water soluble binder are blended, the mixture is agitated until substantially homogeneous pellets are formed. The agitation is effectively accomplished by tumbling the blended mixture in an enclosed container. The pellets are then aged for a period of time sufficient to allow evaporation of at least part of the water near the pellet surface and thereby physically stabilize the pellet structure, rendering the pellets resistant to damage by impact and crushing forces. The physical stability of the pellets to impact and crushing forces allows the pellets to be transported and handled without loss of pellet structure. Resistance to impact forces allows the pellets to be dropped a distance without breaking. Resistance to crushing forces permits the pellets to withstand weight resting upon them without breaking. The resulting pellets comprise and coal particles water and water soluble binder. The water and the water soluble binder cooperate to bind the particles of coal in a manner forming the pellets and with an amount of water entrained in the pellet. When the pellets formed using the method of the present invention are subjected to heat they burst and disintegrate into coal particles. The heat causes conversion of entrained water into gaseous form and the binding forces of the water soluble binder to be lessened. The net effect of the pellet bursting is the formation of coal particles for efficient combustion.

The most effective binders have been found to be water soluble hydrophilic organic polymers such as polyethyleneglycol, methoxypolyethylene glycol and carboxymethylcellulose. Any organic polymers having an abundance of polar atoms such as oxygen or nitrogen are considered hydrophilic in character.

When pellets are coated with a polymeric film their resistance to water damage is facilitated. Pellet coating procedures includes dipping uncoated pellets in a film forming solution and spraying uncoated pellets with a film forming solution. Carboxymethylcellulose cross-linked by ion bridges between some of its carboxyl groups forms an effective polymeric film. Cross-linking agents such as aluminum ions from aluminum acetate and chromium ions from chromium potassium sulfate form cross-links and facilitate carboxymethylcellulose film formation. Once the pellets have been coated with film their resistance to structural damage by subsequent exposure to water is greatly enhanced. Coating the peripheral pellet surface with a water resistant coating however does not alter the heat induced bursting qualities of the pellets or their resistance to impact and crushing forces.

Characteristics of coal pellets produced by the method of the present invention are seen in Table 1, Table 2, Table 3 and Table 4. These tables deal respectively with the effects of a variety of pelletizing conditions upon pellet yield, drop index, crushing strength and water resistance. The pellets tested were produced by the following procedures with the indicated ingredients.

The coal used in these tests was of the bituminous type known as Stigler coal which is surface mined in Haskell County, Okla. and is typically of low to medium volatile rank and with a low sulfur and ash content. Raw coal was ground, dried and passed through a 200 mesh sieve. The coal particles passing through the sieve were used in the production of coal pellets. The water soluble binder used in the bulk of these experiments was a polyethylene glycol (Carbowax, melting at about 63° C., polyethylene glycol 6000, Union Carbide, Inc.). An aqueous solution of water soluble binder was prepared as follows: in one case, 4.4 grams of polyethylene glycol (subsequently PEG) was added to 25 milliliters of water and the mixture was warmed and agitated for a short period of time until a solution was obtained and then allowed to return to room temperature; and in another case, 8.33 grams of PEG was analogously utilized.

Coal pellets were produced by separately using each of the above PEG solutions. Twenty five grams of each PEG solution was separately scattered over the surface of a 100 gram sample of coal particles in a rotating variable speed mixer. The combination was then mixed until the materials were blended (3% PEG and 17% water by weight or 5% PEG and 15% water by weight). The blend was then placed in an agglomerating or balling drum with a diameter of about ten inches. The drum was then rotated at thirty revolutions per minute in one case and fifty revolutions per minute (RPM) in another case to produce pellets by agitation. The effects of temperature during the drum revolution and tumbling of the enclosed blend were studied by blowing air at 90° C. at the rear and closed side of the drum during the drum rotation at either speed and at either PEG concentration. The rotating drum was kept in other cases at about 21° C. In all cases studied, many generally spherical pellets were formed within one minute of drum rotation. The contents of the rotating drum were removed after 5 minutes of rotation and placed on an 8 mesh sieve. Pellets retained on the 8 mesh sieve were used for subsequent tests and procedures. The entire experiment was replicated, the results of the first experiment being seen in the tables as numbers not appended by an "r", and those of the replicate experiment being seen in the tables as numbers followed by an "r". Table 1 contains data on the yield of pellets retained by the 8 mesh sieve after removal from the rotating drum. The higher temperature (90° C.) of agglomeration combined with higher speed of rotation (50 RPM) combine to reduce the yield to some extent. The highest average yield was produced by the low binder (3% PEG) concentration, low RPM and high temperature.

TABLE 1

| CONDITIONS | | | | |
|---|---|---|---|---|
| No. | PEG % | RPM | Temp C.° | YIELD Grams |
| 1 | 3 | 30 | 21 | 69 |
| 1r | 3 | 30 | 21 | 67 |
| 2 | 5 | 30 | 21 | 58 |

TABLE 1-continued

| CONDITIONS | | | | |
|---|---|---|---|---|
| No. | PEG % | RPM | Temp C.° | YIELD Grams |
| 2r | 5 | 30 | 21 | 53 |
| 3 | 3 | 50 | 21 | 64 |
| 3r | 3 | 50 | 21 | 65 |
| 4 | 5 | 50 | 21 | 45 |
| 4r | 5 | 50 | 21 | 56 |
| 5 | 3 | 30 | 90 | 85 |
| 5r | 3 | 30 | 90 | 78 |
| 6 | 5 | 30 | 90 | 71 |
| 6r | 5 | 30 | 90 | 56 |
| 7 | 3 | 50 | 90 | 60 |
| 7r | 3 | 50 | 90 | 60 |
| 8 | 5 | 50 | 90 | 59 |
| 8r | 5 | 50 | 90 | 54 |

The coal pellets retained on the 8 mesh sieve were then either promptly measured for physical characteristics (raw) or first subjected to warming for fifteen minutes at 90° C. (warm). Both raw and warm pellets were tested and then subjected to aging for two days under ambient laboratory conditions before subsequent testing.

Some aged pellets of different types were coated by immersion in a freshly prepared solution of 50 milliliters water, 0.5 grams of carboxymethylcellulose (Type 7L, Hercules, Inc.) and 0.15 grams chromium potassium sulfate (chrome alum, $CrK(SO_4)_2.12\ H_2O$) followed by their prompt removal and drying at about 120° C. (usually for about fifteen minutes).

TABLE 2

| | Drop Index | | | |
|---|---|---|---|---|
| No. | Raw | Warm | Raw Aged | Warm Aged |
| 1 | 22 | 3 | e | 25 |
| 1r | 14 | 20 | e | e |
| 2 | 25 | 12 | e | e |
| 2r | 18 | 16 | e | e |
| 3 | 25 | 7 | e | e |
| 3r | 23 | 7 | e | e |
| 4 | 25 | 25 | e | e |
| 4r | 25 | 22 | e | e |
| 5 | 12 | 9 | 20 | e |
| 5r | 10 | 6 | e | e |
| 6 | 21 | 19 | 21 | e |
| 6r | 25 | 11 | e | e |
| 7 | 24 | 13 | e | e |
| 7r | 12 | 19 | e | e |
| 8 | 25 | 8 | e | e |
| 8r | 25 | 20 | e | e |

Uncoated pellets were measured for resistance to breakage after an 18 inch drop onto a ½ inch steel plate. Several pellets of average size were dropped until they broke or survived more than 25 drops, in which case they were deemed elastic, abbreviated 'e' in Table 2. The Drop Index in Table 2 indicates the average number of drops required to break the pellets. The conditions corresponding to each test number in Table 2, Table 3 and Table 4 are the same as in Table 1. The data shows that both the higher binder concentration and the higher speed of drum rotation tended to produce pellets more resistant to breakage by the 18 inch drop.

TABLE 3

| | Crushing Strength | | | |
|---|---|---|---|---|
| No. | Raw | Warm | Raw Aged | Warm Aged |
| 1 | 0.1 | 0.2 | 2.01 | 0.93 |

TABLE 3-continued

| No. | Raw | Crushing Strength Warm | Raw Aged | Warm Aged |
|---|---|---|---|---|
| 1r | p | 0.6 | 2.62 | 1.25 |
| 2 | p | 0.6 | 4.77 | 2.07 |
| 2r | p | 0.3 | 3.29 | 1.57 |
| 3 | p | 0.3 | 2.66 | 2.05 |
| 3r | p | 0.2 | 2.46 | 1.71 |
| 4 | p | 0.9 | 4.76 | 2.96 |
| 4r | p | 0.5 | 4.03 | 2.98 |
| 5 | 0.1 | 0.3 | 0.82 | 1.74 |
| 5r | 0.1 | 0.2 | 2.18 | 2.07 |
| 6 | p | 0.4 | 3.06 | 2.35 |
| 6r | p | 0.3 | 4.03 | .91 |
| 7 | 0.2 | 0.3 | 2.21 | 1.96 |
| 7r | p | 0.5 | 2.32 | 1.58 |
| 8 | p | 0.2 | 4.16 | 1.55 |
| 8r | p | 0.6 | 4.91 | 2.12 |

The crushing strength of the uncoated pellets was measured for several single pellets of each type by determining the vertical weight which a single pellet could support before being crushed. The average crushing strength of these pellets is represented in Table 3 as the average number of kilograms of weight required to crush a single pellet. The raw pellets fresh from the drum often were plastic (abbreviated 'p' in Table 3), deforming but not breaking. The higher binder concentration tended to produce pellets with the greatest crushing strength.

Both Table 2 and Table 3 indicate that aging for two days dramatically increases the physical strength of the pellets, rendering them stable enough for transportation. Coating was not found to appreciably alter the drop index or the crushing strength of the pellets (not seen in the Tables).

Coated as well as uncoated pellets were measured for resistance to water damage by immersing them in water for fifteen minutes and then draining, drying and counting the surviving undamaged pellets. The data in Table 4 indicates the percentage of pellets able to survive the water immersion intact. Coating the pellets conferred a profound improvement in their resistance to water damage.

TABLE 4

| No. | Water Resistance Raw | Warm | Raw Aged | Warm Aged | Coated Raw Aged | Coated Warm Aged |
|---|---|---|---|---|---|---|
| 1 | 0 | 0 | 0 | 0 | 90 | 90 |
| 1r | 10 | 40 | 0 | 78 | 95 | 95 |
| 2 | 10 | 25 | 10 | 10 | 100 | 90 |
| 2r | 10 | 30 | 0 | 0 | 100 | 100 |
| 3 | 20 | 0 | 0 | 10 | 100 | 100 |
| 3r | 15 | 15 | 0 | 15 | 100 | 100 |
| 4 | 10 | 10 | 5 | 10 | 100 | 70 |
| 4r | 10 | 20 | 0 | 0 | 100 | 100 |
| 5 | 25 | 20 | 15 | 10 | 100 | 95 |
| 5r | 10 | 20 | 0 | 5 | 100 | 100 |
| 6 | 0 | 10 | 0 | 10 | 85 | 95 |
| 6r | 10 | 10 | 0 | 0 | 100 | 95 |
| 7 | 10 | 10 | 0 | 10 | 85 | 100 |
| 7r | 10 | 30 | 30 | 0 | 100 | 95 |
| 8 | 0 | 10 | 0 | 0 | 90 | 90 |
| 8r | 15 | 10 | 0 | 0 | 100 | 90 |

All pellets, coated or uncoated were found to promptly burst when held in a hot environment (generally over 400° C.), thereby returning largely to coal particles within about two seconds. This bursting quality was retained during at least nine months of storage in glass jars.

Carboxymethylcellulose was used as a water soluble hydrophilic binder in place of the polyethylene glycol in several preliminary tests. An aqueous solution containing 5% carboxymethylcellulose (Type 7L, Hercules, Inc.) by weight was first prepared. Twenty-five grams of this solution was blended with 100 grams of coal particles. After agitation for five minutes in an agglomeration drum, pellets were formed. The pellets were removed and sprayed with a 0.3% aqueous solution of chromium potassium sulfate. The pellets, after drying for two days were found to have a low crushing strength, but did still burst upon the application of heat. After storage for over nine months the crushing strength of the pellets was considerably improved. This information indicates that most hydrophilic polymers such as methoxypolyethylene glycol which are soluble in water should function as binders for self-bursting coal pellets.

Changes may be made in the procedures, the sequence of method steps or in the specific ingredients described herein without departing from the spirit and scope of the invention as described in the following claims.

What is claimed is:

1. A pellet which is self-bursting upon the application of heat comprising:

coal particles;

water; and water soluble binder binding the coal particles and entraining the water within the bound coal particles, the entrained water being convertible to a gaseous form upon the application of heat for facilitating the heat induced bursting of the pellet to free the coal particles for more efficient burning.

2. The pellet of claim 1 wherein the water soluble binder is further defined as being a hydrophilic organic polymer.

3. The pellet of claim 2 wherein the hydrophilic organic polymer is further defined as being a polyethylene glycol.

4. The pellet of claim 2 wherein the hydrophilic organic polymer is further defined as being a methoxypolyethylene glycol.

5. The pellet of claim 2 wherein the hydrophilic organic polymer is further defined as being a carboxymethycellulose.

6. The pellet of claim 1 wherein the pellet is defined further to include: a water resistant coating substantially surrounding the outer peripheral surface of the pellet for rendering the pellet substantially resistant to water damage.

7. The pellet of claim 6 wherein the water resistant coating is further defined as being a carboxymethylcellulose film.

8. The pellet of claim 7 wherein the carboxymethylcellulose film is further defined as being stabilized by treatment with a cross-linking agent to enhance the tenacity of attachment of the carboxymethylcellulose to the pellet.

9. The pellet of claim 8 wherein the cross-linking agent is further defined as being chromium ions from chromium potassium sulfate.

10. The pellet of claim 8 wherein the cross-linking agent is further defined as being aluminum ions from aluminum acetate.

11. A method of forming pellets which are self-bursting upon the application of heat, comprising the steps of:

dissolving a water soluble binder in water;

blending coal particles with the solution of water soluble binder in water;

agitating the blend of coal particles, water and water soluble binder until substantially homogeneous pellets are formed; and aging the formed pellets for a period of time sufficient to evaporate at least part of the water near the pellet surface, and physically stabilize the pellets.

12. The method of claim 11 wherein the water soluble binder is further defined as being a hydrophilic organic polymer.

13. The method of claim 12 wherein the hydrophilic organic polymer is further defined as being a polyethylene glycol.

14. The method of claim 12 wherein the hydrophilic organic polymer is further defined as being a methoxypolyethylene glycol.

15. The method of claim 12 wherein the hydrophilic organic polymer is further defined as being a carboxymethylcellulose.

16. The method of claim 11 wherein the agitation of the coal particles, water and water soluble binder to form pellets is further defined as tumbling the coal particles, water and water soluble binder in a substantially enclosed container.

17. The method of claim 11 wherein the aging of the formed pellets is defined further as storing the pellets sheltered from exogenous water for from one to seven days.

18. The method of claim 11 further defined to include the step of coating the pellets with a film of material to confer upon the pellet substantial resistance to damage upon subsequent exposure to exogenous water.

19. The method of claim 18 wherein the film of material for coating the pellets is further defined as being a carboxymethylcellulose.

20. The method of claim 19 defined further to include the step of mixing the carboxymethylcellulose with chromium potassium sulfate during the coating process for enhancing the tenacity of the carboxymethylated cellulose coating to the pellets by cross-linking the carboxymethylcellulose.

21. The method of claim 20 wherein the cross-linking agent is further defined as being chromium ions from chromium potassium sulfate.

22. The method of claim 20 wherein the cross-linking agent is further defined as being aluminum ions from aluminum acetate.

* * * * *